United States Patent [19]

Zdrahal

[11] 4,136,570

[45] Jan. 30, 1979

[54] TRANSMISSION GEAR FOR A WIRE GUIDE OF A WINDING MACHINE

[75] Inventor: Pavel Zdrahal, Adliswil, Switzerland

[73] Assignee: Meteor AG, Rüschlikon, Switzerland

[21] Appl. No.: 781,872

[22] Filed: Mar. 28, 1977

[30] Foreign Application Priority Data

Mar. 31, 1976 [CH] Switzerland ..... 3999/76

[51] Int. Cl.[2] ..... F16H 19/04

[52] U.S. Cl. ..... 74/34; 192/84 AA

[58] Field of Search ..... 74/34; 192/84 AA, 48.91

[56] References Cited

U.S. PATENT DOCUMENTS

| | | | |
|---|---|---|---|
| 761,459 | 5/1904 | Eastwood | 192/84 AA |
| 1,381,801 | 6/1921 | Codding | 74/34 |
| 2,441,854 | 5/1948 | Stolp | 74/34 |
| 3,176,531 | 4/1965 | Plume | 192/84 AA |

*Primary Examiner*—Benjamin W. Wyche
*Assistant Examiner*—Wesley S. Ratliff, Jr.
*Attorney, Agent, or Firm*—Cushman, Darby & Cushman

[57] ABSTRACT

The disclosure embraces a transmission gear for the wire guide of a coil winding machine and includes a rotary input shaft, a pair of electro-magnetic clutches, with each of the clutches having a toothed rack; each of the racks is connected to a rectilinearly movable carriage whereby when one or the other of said electro-magnetic clutches is actuated, the carriage will be moved by the associated toothed rack in a selected direction; limit switches are provided to reverse the direction of travel of the carriage by deactivating a given electro-magnetic clutch and activating the other of said clutches.

5 Claims, 2 Drawing Figures

TRANSMISSION GEAR FOR A WIRE GUIDE OF A WINDING MACHINE

BACKGROUND AND SUMMARY OF THE INVENTION

The present invention relates to a transmission gear especially for a wire guide of a winding machine which is provided with a carriage member which reciprocates on a straight line path. The transmission gear is driven continuously by a shaft rotating in a given direction, which shaft has mounted thereon electro-magnetically actuated clutch members each of which is provided with means for transmitting the rotary power from the drive shaft to the reciprocating carriage member so that the carriage member will be movable in opposite directions along its path depending on which of the clutches is actuated.

Known transmission gears in this field which are used on machines for winding wire into coils have generally employed a driving member in the form of a shaft on which is mounted a pulley or wheel for a first belt together with a second belt and pulley mounted on the same shaft at a distance from the first mentioned pulley. A carriage for the wire guide member is usually mounted to be reciprocated along a given path or track by means of one or the other of the belts. In the past, it has been the practice to mount a pair of magnetic clutches on the carriage itself each clutch of which is connected or associated with one of the drive belts. These clutches, when actuated, would clamp the desired belt to effect movement of the carriage along its track. Conventionally, the distance travelled is dependent upon the period of actuation of a selected magnetic clamp and was usually determined by the positioning of terminal switches in the path of travel of the carriage. Of course the carriage included the wire guide member which moved back and forth with the carriage at a speed corresponding to the speed of rotation of the pulleys and associated belts.

This known arrangement has typically required a relatively large and heavy carriage member to be employed since the magnetic clamping members were mounted directly on the carriage. Also, considerable space is taken up by the drive pulleys themselves and the use of pulleys has limited the number and types of machines with which the transmission gear can be employed since correspondence between the drive pulleys and the associated clamping devices on the carriage is required.

The present invention has for its object the provision of an improved transmission gear where the foregoing disadvantages are avoided. Specifically, the transmission gear of the present invention employs two magnetic clutches mounted on a drive shaft where the output gears of the clutches are idly mounted, i.e., freely rotatable when the associated clutch member is not actuated. Toothed racks are employed to transmit the rotary power from each of the magnetic clutches to the movable carriage member. As will be apparent from the following description, the arrangement of the transmission gear of the present invention results in a substantially more compact transmission gear as well as one that is more stable and able to absorb lateral stresses which may develop during the transmission of power to the carriage. Also, the carriage itself can be made lighter and smaller which is itself a desirable end since the operating life of the apparatus will thus be extended.

The foregoing and other advantages of the present invention will become apparent in the description which follows when considered in connection with the accompanying drawings, in which:

DETAILED DESCRIPTION OF THE INVENTION

Figure 1:
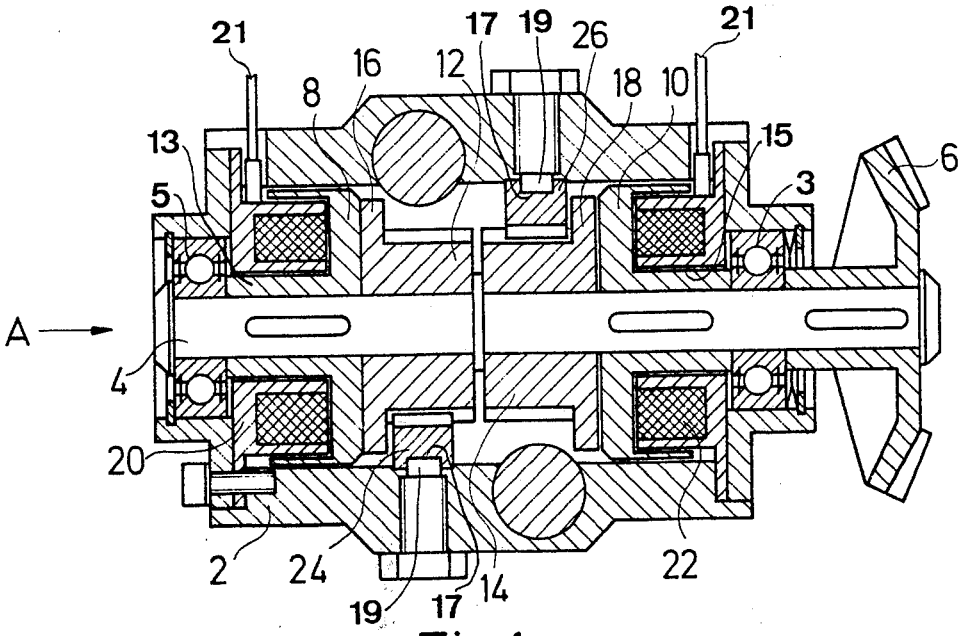
FIG. 1 is an illustration of the transmission gear of the present invention looking perpendicular to the drive shaft.

Referring now to the drawings, wherein like numerals designate corresponding parts throughout, there is shown in FIG. 1 a housing 2 for the transmission gear of the present invention. The housing 2 has a drive shaft 4 mounted therein so as to be freely rotatable in the bearings 3 and 5 located at opposite ends of the housing 2. The shaft 4 may be driven by any suitable means such as by a gear 6 which may be connected to a suitable electric motor (not shown) by means of the usual adjustable gearing.

The shaft 4 carries two electro-magnetically operated clutches each of which includes two coupling flanges 8 and 10 which are disposed facing each other on the shaft 4. The coupling flanges 8 and 10 are fixedly mounted on the drive shaft so as to be rotatable therewith at all times, but may be axially slidable to a small degree. The electro-magnetic clutches further include two gears 12 and 14 which also are shiftable axially of the drive shaft to a limited extent and which are rotatable independent of the drive shaft 4. Each of the gears 12 and 14 is provided with a coupling disc 16 and 18, respectively, which, as illustrated, may be formed integrally with the gears themselves. The disc 16 faces coupling flange 8 whereas the disc 18 faces the coupling flange 10. Stationary ring-shaped electro-magnets 20 and 22 are mounted in the housing 2 and surround the drive shaft 4 as well as the mounting necks 13 and 15 of coupling flanges 8 and 10 respectively.

Figure 2:
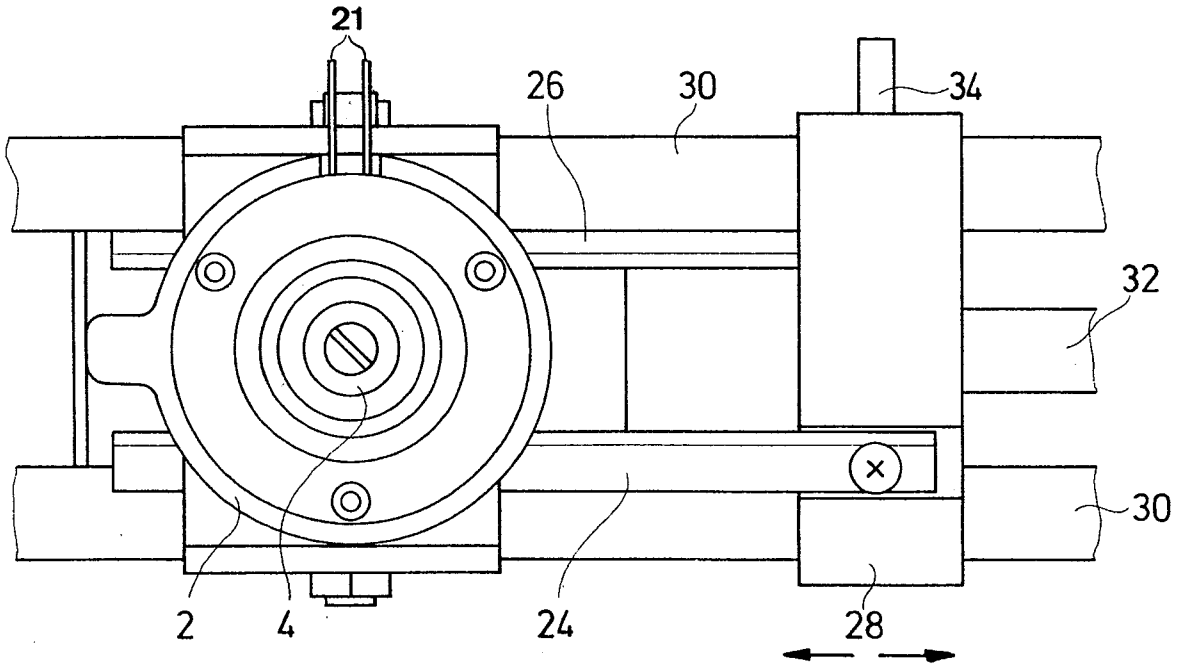
FIG. 2 is a view in the direction of the arrow A of FIG. 1.

Two mutually parallel extending toothed racks 24 and 26 pass through the housing 2 with the teeth of the racks in engagement with the teeth of the gears 12 and 14, respectively. As illustrated in FIG. 1, the toothed racks 24 and 26 extend transversely to the axial direction of the shaft 4 and are on opposite sides of the shaft 4. Each of the racks may be provided with a channel on its side opposite its toothed portion as at 17 so as to be guidable by a lug 19 which is mounted in the wall of the housing 2. As shown in FIG. 2, the toothed racks 24 and 26 are connected with a carriage member 28 in a fixed manner so that the carriage member 28 will always be in engagement with the gears 12 and 14.

The carriage member 28 is disposed to be shiftable rectilinearly on guide bars 30 in a direction parallel to the toothed racks 24 and 26. A driving rod 32 connects the carriage 28 with a wire guide device which is not illustrated. The guide rods 30 which may be supported in any suitable manner, for example, in the housing 2 or the other associated equipment, may also serve as support for the housing 2 on the coil winding machine.

The carriage member 28 may be provided with a peg 34 which is provided for actuating terminal switches (not shown) and thus may be adjustable on the carriage member 28. Of course, both the terminal switches may be movably mounted also to enhance the flexibility of the length of travel of the carriage member 28. The terminal switches, of course, control current to the electro-magnets 20 and 22. Preferably, the terminal switches are of the type that, when actuated, cut off current to one of the electro-magnets while supplying current to the other of the electro-magnets.

The operation of the device will now be described. With the shaft 4 rotating continuously with a selected rpm corresponding to the desired feeding rate of the wire guide, with current being fed to the electro-magnet 20 then a coupling will be formed by the coupling flange 8 and the disc 16 thereby resulting in movement of the toothed rack 24. Assuming that shaft 4 as shown in FIG. 2 rotates continuously in a clockwise direction, then, gear 12 will be driven and the carriage member 28 will be moved to the left as viewed in FIG. 2. The un-illustrated wire guide member connected to the rod 32 will likewise move then leftwardly until the peg 34 contacts the properly located terminal switch device. At that point electro-magnet 20 will be de-activated and the electro-magnet 22 will be activated to establish a coupling between coupling flange 10 and disc 18 thus resulting in rotation of gear 14. Thereupon, gear 14 will drive the carriage 28 to the right as viewed in FIG. 2. As previously noted, the gear, 12 or 14, which is associated with a de-energized electro-magnet will idly rotate when the electro-magnet of the other gear is activated. This rotation is effected by virtue of the fact that the toothed racks are fixedly mounted to the carriage member and thus transmit motion to the respective gear.

The toothed racks by virtue of their guided mounting in the housing 2 provide added stability to the carriage member 28 which, therefore, may be constructed with correspondingly smaller dimensions since the danger of jamming on the guide bars 30 is avoided. Also, as a result of this arrangement, the overall construction of the transmission gear may be kept small in relation to the length of the stroke traversed by the carriage member 28. A further advantage of this arrangement is that the electro-magnets 20 and 22 are stationary thus substantially lightening the weight of the elements that must be moved and permits a designer to omit the use of slip rings to supply current to the electro-magnets. With this arrangement, then, the coupling flanges 8 and 10 operate as flux loops while the discs 16 and 18 serve as the magnetic armatures. It will be apparent also that gears 12 and 14 may be formed as one, integral gear on the shaft 4 instead of two as shown.

It will be noted that the electro-magnets 20 and 22 are connected via leads 21 to the current supply and the terminal switches, respectively, not shown.

It will be understood that the foregoing description of the invention is by way of example only and that various modifications may be made therein without departing from the spirit and scope of the invention as defined in the appended claims.

What is claimed is:

1. Apparatus for converting rotary motion to rectilinear motion, selectively in alternating directions, comprising:

a member disposed to be movable back and forth along the rectilinear path, rotary drive means including a drive shaft, first actuatable electro-magnetic clutch means associated with said rotary drive means for moving, when actuated, said member in one direction and second actuatable electro-magnetic clutch means associated with said rotary drive means for moving, when actuated, said member in a direction opposite to said one direction, each of said clutch means including a rotary coupling member mounted on said drive shaft to be rotatable therewith, a rotary gear member which is rotatable with said rotary coupling member when said respective electro-magnetic clutch means is actuated, said rotary gear member being idly mounted on said drive shaft, each said rotary gear member having a coupling disc carried thereon with each said rotary gear member and each said coupling member of each said clutch means being relatively axially movable on said drive shaft, each clutch means further including a toothed rack having one end connected to said movable member, each said rack being in engagement with one of said rotary gear members so that rotation of a said gear member will effect translation of a said rack engaged therewith, said rotary gear members being located on said drive shaft between said coupling members of said first and second clutch means, said first clutch means including a stationary electro-magnet located externally of its said coupling member on one side of said rotary gear members and said second clutch means including a stationary electro-magnet located externally of its said coupling member on the other side of said rotary gear member of said second clutch means, said apparatus including a housing having an interior surface on which is supported each said stationary electro-magnet.

2. The apparatus as claimed in claim 1 wherein said rotary drive means is a drive shaft and said rack for said first clutch means is located on one side of said drive shaft and extends transversely thereof with the rack of said second clutch means being disposed on the opposite side of said shaft.

3. The apparatus as claimed in claim 1 wherein a housing is provided for said apparatus and said toothed racks are shiftably mounted in said housing, said housing having guide means for each said rack.

4. The apparatus as claimed in claim 1 wherein said rotary coupling members of each said clutch means are rotatable in the same direction as said rotary drive means.

5. The apparatus as claimed in claim 1 wherein said movable member includes control means for actuating and de-actuating said electro-magnetic clutch means in relation to the position of said member.

* * * * *